US005362116A

United States Patent [19]

Doyle et al.

[11] Patent Number: 5,362,116

[45] Date of Patent: Nov. 8, 1994

[54] SELF LATCHING MAGNETIC LATCHING DEVICE

[76] Inventors: David Doyle, 7130 Young Street, Cremorne, New South Wales 2089; Neil Dunne, 5/19-23 Cairo Street, Cammeray, New South Wales 2062, both of Australia

[21] Appl. No.: 969,190

[22] PCT Filed: Aug. 12, 1991

[86] PCT No.: PCT/AU91/00357

§ 371 Date: Apr. 27, 1993

§ 102(e) Date: Apr. 27, 1993

[87] PCT Pub. No.: WO92/03631

PCT Pub. Date: Mar. 5, 1992

[30] Foreign Application Priority Data

Aug. 13, 1990 [AU] Australia ..... PK 1704
Mar. 15, 1991 [AU] Australia ..... PK 5138

[51] Int. Cl.[5] ..... E05C 1/06

[52] U.S. Cl. ..... 292/144; 292/251.5; 292/DIG. 62

[58] Field of Search ..... 292/137, 144, 177, 251.5, 292/DIG. 62

[56] References Cited

U.S. PATENT DOCUMENTS

| | | | |
|---|---|---|---|
| 1,958,940 | 5/1934 | Cavanaugh et al. | 292/177 X |
| 2,219,186 | 10/1940 | Hornfeck | 292/251.5 X |
| 2,288,688 | 7/1942 | Dubilier | 292/177 X |
| 2,514,927 | 7/1950 | Bernhard | 292/1 |
| 2,690,349 | 9/1954 | Teetor | 292/251.5 |
| 2,942,907 | 6/1960 | Nagel et al. | 292/251.5 |
| 3,334,936 | 8/1967 | Hekelaar et al. | 292/251.5 |
| 3,516,701 | 2/1970 | Graham | 292/144 |
| 3,794,366 | 2/1974 | Graham | 292/251.5 X |
| 4,848,812 | 7/1989 | Slaughter | 292/144 |

FOREIGN PATENT DOCUMENTS

| | | | |
|---|---|---|---|
| 138996 | 4/1948 | Australia . | |
| 1180547 | 12/1958 | France | 292/251.5 |
| 211470 | 1/1989 | New Zealand . | |
| 693564 | 7/1953 | United Kingdom | 292/251.5 |
| 1108996 | 4/1968 | United Kingdom . | |
| 9203631 | 3/1992 | WIPO | 292/251.5 |

*Primary Examiner*—Rodney M. Lindsey
*Attorney, Agent, or Firm*—Marshall, O'Toole, Gerstein, Murray & Borun

[57] ABSTRACT

A self latching device is disclosed which is arranged to latch in a predetermined position, two members which are otherwise movable relative to each other. The device comprises a latch arm arranged to be mounted to one of the members and which is movable between a latched and a retracted position , and a retaining element incorporating a permanent magnet arranged to be mounted to the other member. The latch arm is spring biased into the retracted position but, when in the predetermined position, is caused to move by the magnetic field generated by the magnet into the latched position wherein any substantial relative movement of the two members is prevented by the latch arm engaging the retaining element.

8 Claims, 4 Drawing Sheets

SELF LATCHING MAGNETIC LATCHING DEVICE

TECHNICAL FIELD

The present invention relates to latches suitable for use on gates, doors, cupboards and the like and may be applied in a wide variety of installations. The present invention will be exemplified with reference to the particular problem of hinged swimming pool gates, which requires secure automatic latching on closure, but it is to be understood that the invention extends to embodiments intended for other applications including sliding doors and other structures.

BACKGROUND ART

To prevent young children from entering a pool area without supervision, safety pool fences are usually required by law. These safety pool fences include a self latching device which is arranged to operate automatically on closing of the gate of the fence and prevents the gate from being reopened without manual releasing of the mechanism. Usually a self closing mechanism such as spring hinges is also provided on the gate to bias the gate to a closed position.

A typical latch device for a pool gate incorporates a latch bolt which is arranged to strike a rotatable notched disc located in a recess in the adjacent fence post. Striking of the disc by the latch bolt causes the disc to rotate and capture the latch. A problem exists with this type of self latching device in that a certain amount of force is required by the latch bolt to rotate the disc. In the past, it has been found that these self latching devices sometimes do not operate properly when the gate is released just off its closed position. In these instances, as the gate moves under the influence of the self closer towards its closed position the latch bolt does not strike the rotatable disc with sufficient force to cause rotation of the disc. Consequently, the self latching device does not engage properly and although the gate appears closed it is not latched.

DISCLOSURE OF INVENTION

The present invention aims to ameliorate the above problem by providing a self latching device which is positively biased to operate when required. In the present invention the biasing force is provided by a magnetic field.

Accordingly the present invention provides a self latching device for latching, in a predetermined position, two members which are otherwise moveable relative to one another, the device comprising a latch arm and a retaining element which in use provides a latching shoulder for the latch arm to prevent relative movement of the members, at least one of the latch arm and the retaining element providing a strong magnetic field and the other having magnetic properties, the latch arm being arranged to be displaceably mounted on a first of said members and the retaining element being arranged to be associated with the second of said members, the latch arm being such that, only when the members are in the predetermined position and the latch arm and retaining element are axially aligned, under the influence of the magnetic field will the latch arm and retaining element undergo relative movement into a latching position wherein any substantial relative movement of the two members is prevented by the latch arm and latching shoulder interengaging, and the latch arm being displaceable under substantial manual force away from the retaining element to a retracted position so that the members may be moved apart, the device comprising a biasing means which biases the latch arm to the retracted position with a force less than an opposing force imparted on the latch arm by the magnetic field, the latch arm being moveable in a vertical direction between the latching position and the retracted position and including a first portion displaceably mounted within a through passage in a housing, a first end of the first portion extending from a first end of the through passage and engaging with the latching shoulder in the latching position, a sleeve connected to a second opposite end of the first portion which extends from a second end of the through passage and a second portion mounted substantially above and in line with the first portion and having a first end connected to the coupling member and a second, opposite end mounting a lift knob, the biasing means being disposed adjacent the through passage abutting against the housing and extending therebetween and a portion of the latch arm to bias the first portion into the retracted position, the second portion being moveable by way of the lift knob between a lower position and an upper position, one of either the first or second portions being rigidly connected to the sleeve, whereas the other is captured by the sleeve and is capable of limited movement with respect thereto, such that when the second portion is in the lower position the first portion can move independently of the second portion between the retracted position and the latching position, whereby the biasing means need not support the weight of the second portion when the latch arm is in the retracted position, but when the latch arm is in the latched position lifting of the lift knob to the upper position causes movement of the first portion to the retracted position.

It should be realised that the retaining element could be integrally formed as part of one of the members.

Preferably, the self latching device is arranged such that when the members are located adjacent the predetermined position, the magnetic field biases the members into the predetermined position as well as biasing the latch arm into the latching position.

In the preferred embodiments of the present invention the means for providing the magnetic field comprises a permanent magnet and preferably this permanent magnet is located in a recess in the retaining element. However, the permanent magnet could be arranged in any other suitable location such as at the periphery of the recess.

The latch device may also incorporate biasing means acting on the latch arm to bias the latch arm into the retracted position. In this arrangement the biasing means is arranged to impart a force on the latch arm which is less than the biasing force imparted on the latch arm by the magnetic field when the members are located in the predetermined position. This ensures that the biasing means does not prevent the magnetic field biasing the latch arm from the retracted position to the latching position when the members are in the predetermined position.

Preferably the permanent magnetic is a rare earth magnet formed from neodymium iron boron alloy.

Typically the device would be coated with suitable material to resist corrosion. In the preferred embodiment the outer housing and retaining members are aluminium powder coated whereas the latch bolt is chrome or cadmium plated mild steel. The magnet would typically be coated in a plastics material which would prevent corrosion but not inhibit the magnetic field generated therefrom. Alternatively, the magnet could be sealed in the retaining member by welch plugs which are typically silicone sealed to the retaining member.

In a preferred embodiment a spring such as a helical compression spring displaces the latch arm to a retracted position and spring pressure only needs to support the weight of the engaging part of the latch arm. The spring pressure is relatively low and this is simply overcome by the magnetic forces applicable when the latch arm is moved to a position in which latching can take place.

The vertical displacement embodiments of the invention are suitable for installation on swimming pool gates where a knob or similar actuating member is to be positioned much higher than the gate itself so that young children cannot reach the actuating member and open the gate. One known form of actuating arrangement of this general type is incorporated in a steel elongated gate post, but further embodiments of the present invention can offer enhanced performance characteristics and the convenience of easy installation and indeed replacement on site as the entire latch mechanism is simply screwed to the gate and the gate post respectively.

To release the self latching device according to preferred forms of the invention, it would typically be necessary to pull manually the latch arm to the retracted position. A particular advantage of the preferred embodiment of the present invention is that the biasing force of the magnetic field can be accurately set by choosing a suitable strength of magnet and/or regulating the size of the surface which is caused to contact the magnet. This is particularly beneficial as it enables the force required to release the latch device to be set such that it is too hard for a young child to release the device but sufficiently easy for an adult.

Further embodiments of the invention can readily incorporate a lock with a removable key.

BRIEF DESCRIPTION OF DRAWINGS

Embodiments of the invention will now be described by way of example only with reference to the accompanying drawings in which.

BEST MODE FOR CARRYING OUT THE INVENTION

Figure 1:
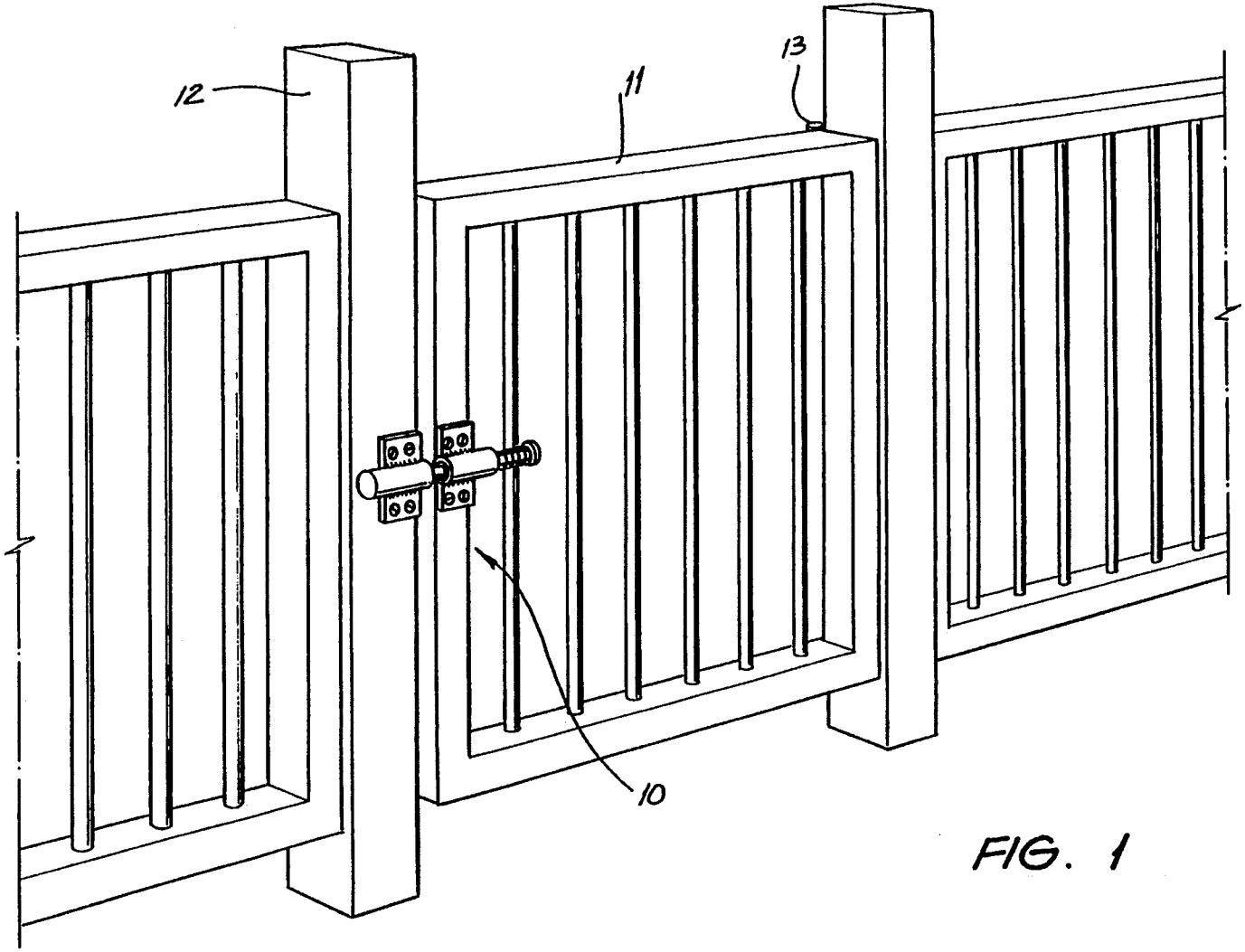
FIG. 1 is a schematic view of a self latching device not in accordance with the present invention when attached to a gate of a pool safety fence.
Figure 2:
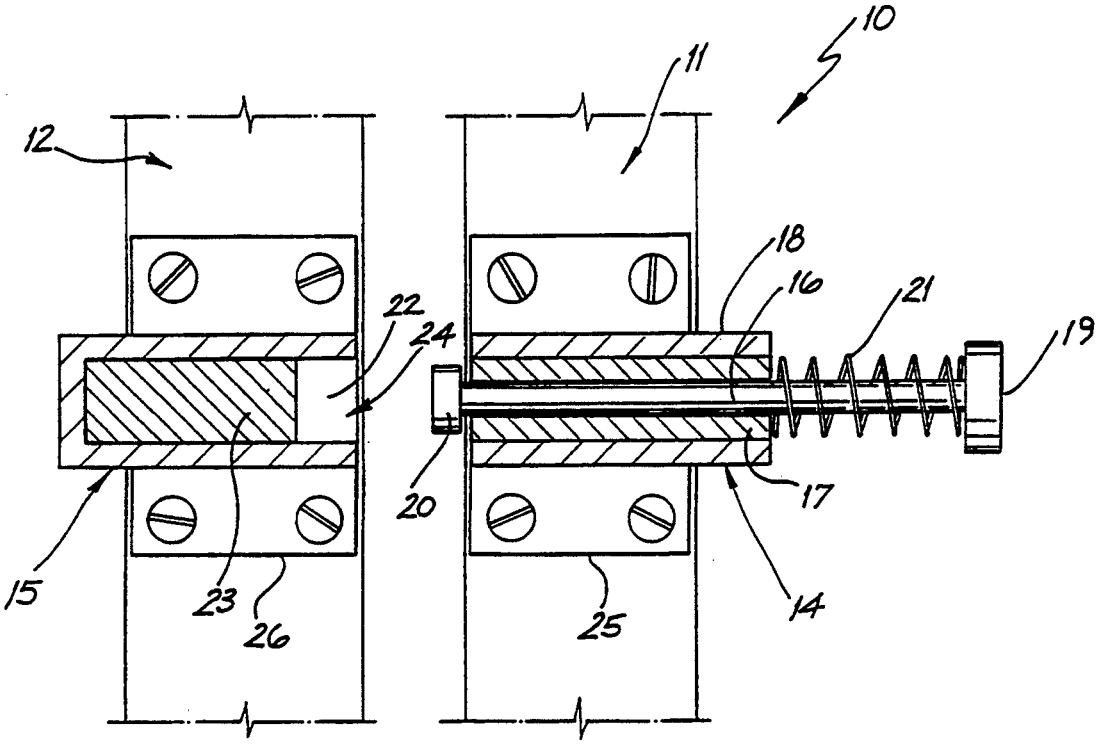
FIG. 2 is a detailed sectional view of the self latching device of FIG. 1 shown in the retracted position.
Figure 3:
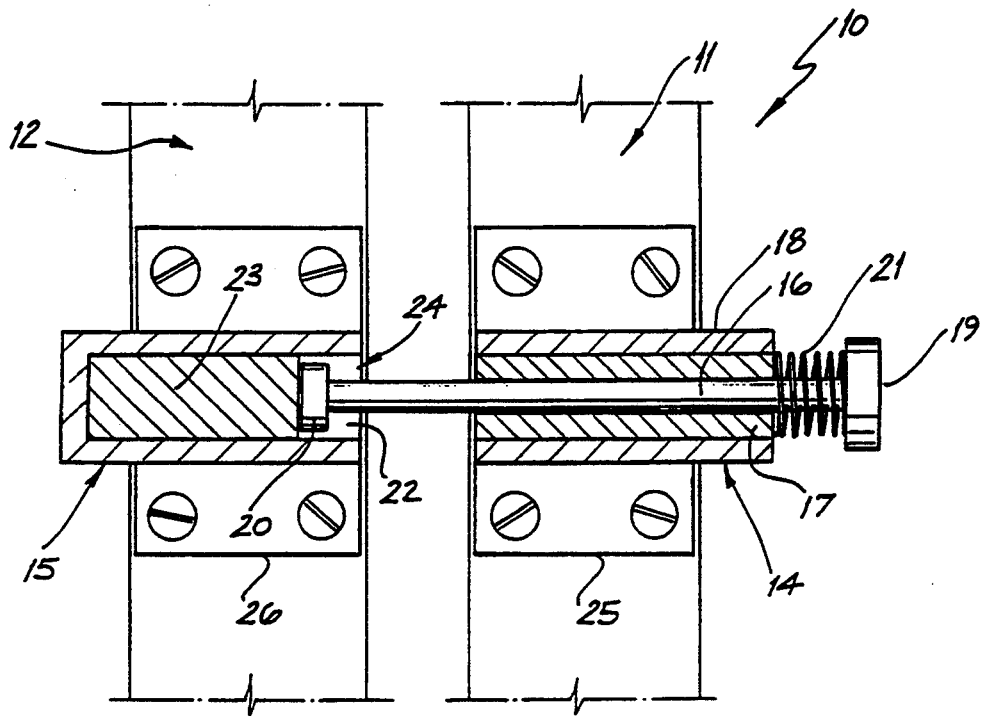
FIG. 3 is the view of FIG. 2 showing the self latching device in the latched position.

Referring first to FIG. 1 to 3 and as best shown in FIG. 1, a self latching device which is not in accordance with the present invention will be described. A in lieu thereof self latching device 10 is fitted to a gate 11 and its adjacent fence post 12. The device is arranged to operate automatically when the gate is closed to prevent the gate from being reopened without releasing of the latch mechanism. Typically the gate 11 is mounted to the fence on spring hinges 13 which bias the gate to the closed position.

FIGS. 2 and 3 illustrate the mechanism of the self latching device 10.

As can be seen, the self latching device 10 comprises two separate parts, namely a latch arm assembly 14 and a retaining member 15. The latch arm assembly comprises a latch bolt 16 which is slidable in a sleeve 17 in the direction of its axis between a first or latching position as shown in FIG. 3 and a second or retracted position as shown in FIG. 2. Typically this sleeve 17 has an inner surface coating formed of Teflon (a registered trade mark of Du Pont) to facilitate movement of the bolt in the sleeve. The sleeve is mounted to a housing 18 which is connected to the gate 11 by way of mounting plate 25 which is screwed to the gate.

The latch bolt 16 is of chrome or cadmium plated mild steel, which is magnetic, and incorporates a bolt head 19 on its rear end and an engaging plate 20 on its leading end. The engaging plate 20 would typically be formed from cold forming the end of the latch bolt 20. The bolt head 19 and the engaging plate 20 ensure that the latch bolt 20 remains within the sleeve 17.

A compression spring 21 is located between the bolt head 19 and the housing 18 to bias the latch bolt into the second position.

The latch bolt 16 is arranged to be received in the retaining member 15 when the gate is in the closed position. The retaining member incorporates a recess 22 adapted to receive the latch bolt, and is mounted to the fence post 12 adjacent the gate 11 through mounting plate 26. Although the retaining member 15 is illustrated as being separate from the fence post 12 it should be appreciated that it could easily be incorporated as an integral part of the fence post 12.

The retaining member also incorporates a permanent magnet 23, which is located in the recess 22 at the opposite end to the recess opening 24. The magnet is a centre orientated rare earth permanent magnet formed typically from neodymium iron boron alloy. This type of magnet has been found to be ideal for this application due to its high field strength. With the inclusion of the magnet 23, a magnetic field is generated in the vicinity of the retaining member 15 and this magnetic field attracts the engaging plate 20 of the latch bolt to cause the latch bolt to be positively biased into the first or latched position when the gate 11 is in or adjacent the closed position. The biasing force caused by the magnetic field is substantially greater than the biaising force imparted on the latch bolt 16 by the compression spring 21 when the gate is closed. In this way, the compression spring 21 does not inhibit movement of the latching bolt into its latched position.

Once in the latched position, the latch bolt 16 is located in the recess 22 and opening of the gate is prevented. To reopen the gate, the bolt is manually pulled into its retracted position wherein the bolt 16 is remote from the recess 21. Once in this position the gate is then free to be opened.

The diameter of the recess 23 is arranged to be larger than the diameter of the latch bolt 16 or the engaging plate 20. Furthermore, the magnet 23 is arranged to have an exposed surface which is larger than the suface of the engaging plate 20 which contacts the magnet. With this arrangement the latch bolt 16 can be received within the recess 22 when the gate is just offset from its fully closed position. As the magnet is centre orientated, the bolt will tend to locate along the centre axis of the recess and this position is arranged to coincide with the gate being in a fully closed position. Consequently, the magnetic field is able to bias the latch bolt into its latched position as well as positively bias the gate into its fully closed position.

Typically to prevent corrosion of the self latching device 10, the retaining member 15 and the housing 18 are aluminium powder coated, the latch bolt 16 is chrome plated steel whereas the magnet 23 is coated in a plastics material.

The strength of the biasing force acting on the latch bolt 16 by the magnetic field generated from the magnet 23 can be set by either choosing an appropriate strength of magnet, changing the size of the engaging surface of the engaging plate 20 or a combination of both. In this way, the required force to release the mechanism can be set, such that a child cannot release the mechanism but an adult can effect release without much difficulty. Typically the force required to release the latch would be less than 50 Newtons.

Alternatively, the strength of biasing force acting on the latch bolt is set such that a child can release the mechanism, but the latching device is located in a position where children cannot reach the device. This can be achieved by screening the latching device by a perspex shield or locating the latch at a height which a child cannot reach.

Figure 4:
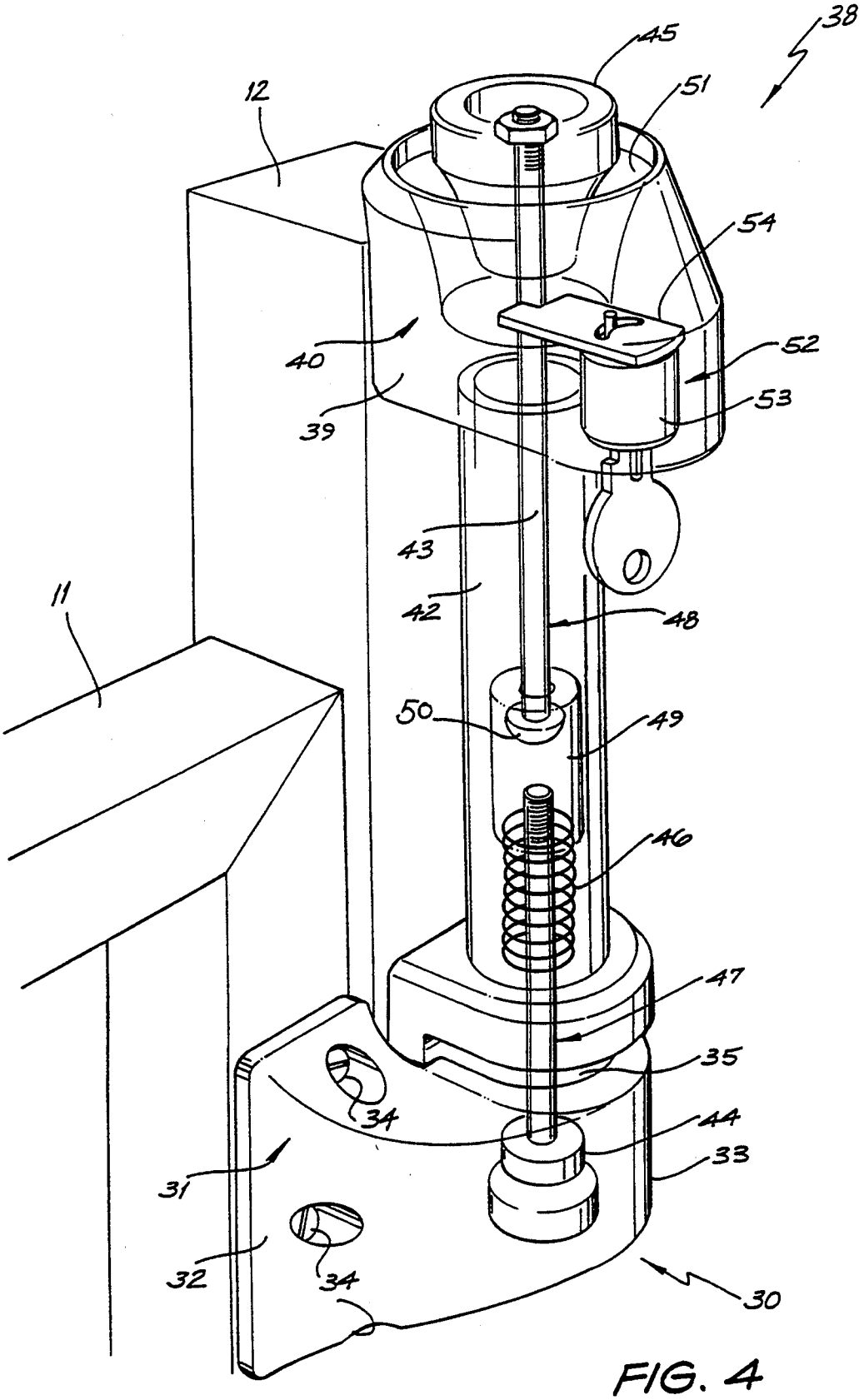
FIG. 4 is a partly broken away perspective illustration of an embodiment of the invention installed on a swimming pool gate and post structure.
Figure 5:
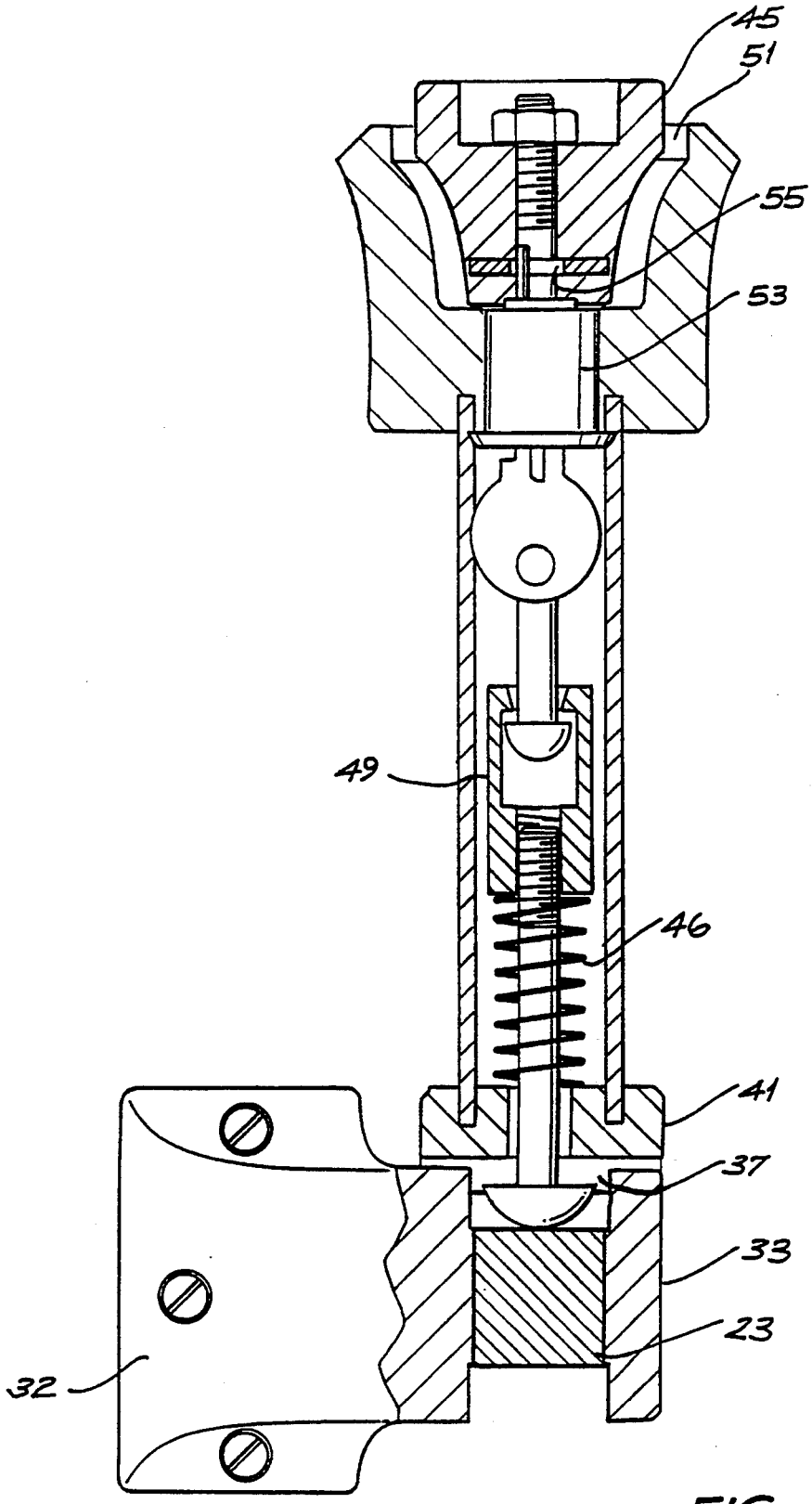
FIG. 5 is a schematic elevation partly in section of the embodiment of FIG. 4.

An embodiment of the latching device in accordance with the present invention is shown in FIGS. 4 and 5. The latching device incorporates a retaining member and a separate latch arm assembly. The retaining member is secured to the gate 11 and the latch arm assembly is secured to the adjacent fence post 12. Furthermore, to move between a latched and a retracted position, the latch arm assembly is displaced in a vertical direction.

The retaining element 30 of this embodiment comprises a housing 31 in which the permanent magnet 23 (FIG. 5) is contained. The magnet 23 is formed from a rare earth metal, typically neodymium iron boron alloy. The housing 31, which is formed from a structural plastics material, is shaped such that it has a mounting portion 32 and an outer extending portion 33. The mounting portion 32 incorporates apertures which are arranged to receive mounting screws 34 to mount the retaining element 30 to the gate whereas the outer engaging portion houses the magnet 23 which protudes from the gate such that it contacts the lower end 41 of the latch arm assembly 38 on closing of the gate 11.

The outer extending portion 33 of the housing incorporates a recess 35 which extends vertically from the top of the retaining member. Within this recess the magnet 23 is located and the wall surface of the recess 35 provides the latching shoulder for the latch arm assembly. To facilitate location of the magnet in the recess 35 an access port (not shown) is located on the side of the housing 31 which faces the fence post 12. Once the magnet is correctly located in the recess 35, the access port is closed off by a relatively soft closure member (not shown) which is glued in position. In this way, the soft closure member also acts as an impact absorbing bearing surface against which the fence post or the lower end 41 of the latch assembly contacts on closure of the gate.

The latch arm assembly 38 includes a housing 39 having an upper end 40, a lower end 41 interconnected by an elongate extension tube 42. In an alternate form (not shown), the latch arm assembly is located within the fence post itself which acts as the housing 39.

Within the latch arm housing 39 a latch bolt 43 is located and is moveable therein in a vertical direction between a latching postion wherein the bolt 43 extends below the lower end 41 of the housing 39 to a retracted position where it is located adjacent the lower end The latch arm assembly 38 is secured to the fence post 12 such that as the gate closes, the lower end 41 contacts the outer engaging portion 33 of the retaining element and is arranged such that on contact, the latch bolt 43 is orientated directly over the recess 35. To ensure correct orientation of the latch bolt over the recess 35, the latch bolt 43, when in the retracted position, is arranged to extend slightly below the lower end 41 of the housing 39 and the outer extending portion 33 of the retaining element incorporates a cut-out portion 37 at the top of the side surface of the recess 35 through which the latch bolt in the retracted position passes when the gate moves to a closed position. In this way, the latch bolt passes through this cut-out portion and into the recess 35 on closure of the gate and further movement of the latch bolt is prevented by the wall surface of the retaining element which is opposite the cut-out portion.

The leading end 44 of the latch bolt 43 is formed from chrome or cadmium plated mild steel which is magnetic such that when located in the recess 35 the latch bolt comes under the magnetic force of the permanent magnet. This force causes the latch bolt to move to the latched position wherein the leading end 44 moves below the bottom of the cut-out portion to a position wherein it is completely surrounded by the wall surface of the recess 35 and in this position any relative movement of the gate relative to the fence post is prevented. To assist correct centre orientation of the latch bolt 44 in the recess 35, the leading end 44 of the latch bolt is dome shaped. To reopen the gate, the latch bolt is manually pulled to the retracted position and a lift knob 45 is located at the top of the latch bolt to facilitate this movement.

As it is necessary that the latch bolt 43 is in the retracted position to enable it to be correctly located over the recess 35, a compression spring 46 acts on the latch bolt 43 to bias the latch bolt into the retracted position. The force exerted on the latch bolt by the spring 46 is less than the force exerted by the magnetic field from the magnet 23 when the latch bolt is located over the recess 35. In this way, when the latch bolt 43 is remote from the recess 35, the latch bolt is forced into the retracted position by the compression spring. However, once over the recess, the magnetic influence of the magnet 23 is sufficiently great to overcome the biasing force and cause the latch bolt to move to the latched position.

As the latch bolt is vertically orientated, to keep the latch bolt in the retracted position, the compression spring 46 must be sufficiently strong to support the weight of the latch bolt. To reduce the weight component of the latch bolt acting on the compression spring, the latch bolt is broken into two sections 47 and 48 which are interconnected by a sleeve 49. The lower section 47 incorporates the leading end 44 on its lower end and on its upper end is rigidly secured to the sleeve 49 typically by way of screw thread. The upper section 48 has the lift knob on its upper end and its lower end is captured within the sleeve by way of knob 50. In this way, limited relative vertical movement is possible between the upper section 48 relative to the sleeve 49.

The lifting knob is arranged to sit on a seat 51 provided in the upper end of the latch arm housing 39, leaving the lower end of the upper section 48 to float in the sleeve 49. In this way, the upper section does not transfer any weight onto the lower section 47 and as such the compression spring 46 only has to support the weight of the lower section 47 and the sleeve 49.

The latch bolt is arranged such that when the lifting knob is located in the seat 51, the lower section 47 is able to move between the latched and retracted position without imparting any corresponding movement to the upper section 48. However, when the latch bolt is to be released from the latch position, upward movement of the lift knob initially causes movement of the upper section 48 relative to the sleeve 49 until such time as the knob 50 contacts the inner top surface of the sleeve wherein further movement of the lift knob causes the simultaneous movement of both the upper and lower sections (47, 48) of the latch bolt 43 enabling movement of the latch bolt to the retracted position.

The upper end of the latch arm housing also incorporates a locking mechanism 52. A key operated rotatable barrel lock 53 is located within the upper end housing 40 and rotation of the barrel lock causes a sliding movement of a locking plate 54 into or out of engagement with a groove 55 located in the lift knob. Once in engagement with the groove, the locking plate prevents the lifting of the lift knob and locks the latch arm in the latched position.

We claim:

1. A self latching device for latching, in a predetermined position, two members which are otherwise moveable relative to one another, the device comprising a latch arm and a retaining element which in use provides a latching shoulder for the latch arm to prevent relative movement of the members, at least one of the latch arm and the retaining element providing a strong magnetic field and the other having magnetic properties, the latch arm being arranged to be displaceably mounted on a first of said members and the retaining element being arranged to be associated with the second of said members, the latch arm being such that, only when the members are in the predetermined position and the latch arm and retaining element are axially aligned, under the influence of the magnetic field will the latch arm and retaining element undergo relative movement into a latching position wherein any substantial relative movement of the two members is prevented by the latch arm and latching shoulder interengaging, and the latch arm being displaceable under substantial manual force away from the retaining element to a retracted position so that the members may be moved apart, the device comprising a biasing means which biases the latch arm to the retracted position with a force less than an opposing force imparted on the latch arm by the magnetic field, the latch arm being moveable in a vertical direction between the latching position and the retracted position and including a first portion displaceably mounted within a through passage in a housing, a first end of the first portion extending from a first end of the through passage and engaging with the latching shoulder in the latching position, a sleeve connected to a second opposite end of the first portion which extends from a second end of the through passage and a second portion mounted substantially above and in line with the first portion and having a first end connected to the sleeve and a second, opposite end mounting a lift knob, the biasing means being disposed adjacent the through passage abutting against the housing and extending therebetween and a portion of the latch arm to bias the first portion into the retracted position, the second portion being moveable by way of the lift knob between a lower position and an upper position, one of either the first or second portions being rigidly connected to the sleeve, whereas the other is captured by the sleeve and is capable of limited movement with respect thereto, such that when the second portion is in the lower position the first portion can move independently of the second portion between the retracted position and the latching position, whereby the biasing means need not support the weight of the second portion when the latch arm is in the retracted position, but when the latch arm is in the latched position lifting of the lift knob to the upper position causes movement of the first portion to the retracted position.

2. A self latching device as claimed in claim 1, wherein the retaining element incorporates a recess having an internal wall surface which forms the latching shoulder for the self latching device.

3. A self latching device as claimed in claim 2 wherein the magnetic field is generated by permanent magnet located within the recess and the latch arm has magnetic properties.

4. A self latching device as claimed in claim 1 wherein the magnetic field is generated by a permanent magnet.

5. A self latching device as claimed in claim 4, wherein the magnet is a rare earth permanent magnet, formed from neodymium iron boron alloy.

6. A self latching device as claimed in claim 1 which further comprises a key operated locked mechanism which is operable to lock the latch arm in the latched position.

7. A self latching device as claimed in claim 1, the lift knob being located outside the housing and arranged to sit on a seat formed in the housing, the arrangement being such that when the lift knob is located on the seat, the first portion can move independently of the second portion between the latching and retracted positions, but when the latch arm is in the latching position, lifting of the lift knob causes an initial movement of the second portion relative to the first portion and thereafter causes a corresponding movement to be imparted to the first portion by virtue of the second portion captured in the sleeve engaging an edge surface of the sleeve, the corresponding movement causing the first portion to disengage the latching shoulder thus enabling the latch arm to move to the retracted position.

8. A self latching device as claimed in claim 1, the first portion and second portion comprising first and second elongate rods, respectively.

* * * * *